US011715886B2

(12) United States Patent
Gorbachov

(10) Patent No.: US 11,715,886 B2
(45) Date of Patent: Aug. 1, 2023

(54) LOW-COST, IPD AND LAMINATE BASED ANTENNA ARRAY MODULE

(71) Applicant: Mobix Labs, Inc., Irvine, CA (US)

(72) Inventor: Oleksandr Gorbachov, Irvine, CA (US)

(73) Assignee: Mobix Labs, Inc., Irvine, CA (US)

( * ) Notice: Subject to any disclaimer, the term of this patent is extended or adjusted under 35 U.S.C. 154(b) by 0 days.

(21) Appl. No.: 17/241,448

(22) Filed: Apr. 27, 2021

(65) Prior Publication Data

US 2021/0351518 A1 Nov. 11, 2021

Related U.S. Application Data

(60) Provisional application No. 63/021,789, filed on May 8, 2020.

(51) Int. Cl.

| | |
|---|---|
| ***H01Q 21/06*** | (2006.01) |
| ***H01Q 5/30*** | (2015.01) |
| ***H01Q 1/22*** | (2006.01) |

(52) U.S. Cl.

CPC ..... *H01Q 21/065* (2013.01); *H01Q 1/2208* (2013.01); *H01Q 1/2283* (2013.01); *H01Q 5/30* (2015.01)

(58) Field of Classification Search

CPC .... H01Q 21/06; H01Q 21/065; H01Q 1/2208; H01Q 1/2283; H01Q 1/38; H01Q 9/04; H01Q 9/0407; H01Q 9/0414

See application file for complete search history.

(56) References Cited

U.S. PATENT DOCUMENTS

| | | | | |
|---|---|---|---|---|
| 9,807,882 | B1 * | 10/2017 | Berdy | H03H 7/0115 |
| 10,056,922 | B1 * | 8/2018 | Tsvelykh | H01P 1/20 |
| 11,088,090 | B1 * | 8/2021 | Brunner | H01L 21/4857 |
| 2008/0246680 | A1 | 10/2008 | Rawnick et al. | |
| 2012/0062439 | A1 * | 3/2012 | Liao | H01L 25/16 29/25.01 |

(Continued)

OTHER PUBLICATIONS

Y. P. Zhang, Duixian Liu; "Antenna-on-Chip and Antenna-in-Package Solutions to Highly Integrated Millimeter-Wave Devices for Wireless Communications"; IEEE Transactions on Antennas and Propagation; Oct. 2009; (13 pages).

(Continued)

*Primary Examiner* — Jason Crawford
(74) *Attorney, Agent, or Firm* — Stetina Brunda Garred & Brucker

(57) ABSTRACT

An antenna array module includes two or more antenna elements arranged in an array, each of the two or more antenna elements formed as a respective integrated passive device (IPD), and a multi-layer printed circuit board (PCB) including one or more metal layers forming one or more feed lines of the antenna elements. The antenna array module may include a radio frequency (RF) front end integrated circuit disposed on an opposite side of the multi-layer PCB from the two or more antenna elements. One or more signal output pins of the RF front end integrated circuit may be connected to the one or more feed lines. The antenna array module may include conductive contacts external to the multi-layer PCB for routing input signals through the multi-layer PCB to one or more signal input pins of the RF front end integrated circuit.

20 Claims, 4 Drawing Sheets

(56) References Cited

U.S. PATENT DOCUMENTS

| | | | | |
|---|---|---|---|---|
| 2013/0194754 | A1* | 8/2013 | Jung | H05K 1/0216 361/720 |
| 2014/0028518 | A1* | 1/2014 | Arnold | H01Q 1/2283 343/841 |
| 2014/0266947 | A1* | 9/2014 | Chen | H01Q 21/065 343/772 |
| 2015/0214595 | A1 | 7/2015 | Mckinzie, III | |
| 2015/0325925 | A1* | 11/2015 | Kamgaing | H01L 21/4853 343/893 |
| 2016/0020165 | A1* | 1/2016 | Kamgaing | H01L 23/49894 257/532 |
| 2016/0352023 | A1* | 12/2016 | Dang | H01Q 1/48 |
| 2017/0149112 | A1 | 5/2017 | Almgren et al. | |
| 2018/0084637 | A1* | 3/2018 | Ueda | H05K 1/0219 |
| 2018/0332151 | A1* | 11/2018 | Kamgaing | H04M 1/0277 |
| 2018/0337458 | A1* | 11/2018 | Rodríguez | H01Q 1/2266 |
| 2018/0342788 | A1 | 11/2018 | Lasiter et al. | |
| 2019/0139818 | A1 | 5/2019 | Peidous et al. | |
| 2019/0165449 | A1* | 5/2019 | Kim | H01L 23/66 |
| 2019/0214369 | A1 | 7/2019 | Seidemann et al. | |
| 2019/0221937 | A1* | 7/2019 | Onaka | H01Q 21/28 |
| 2019/0305428 | A1* | 10/2019 | Hwang | H01Q 19/005 |
| 2020/0066663 | A1* | 2/2020 | Aleksov | H01L 23/5389 |
| 2020/0176376 | A1* | 6/2020 | Ndip | H01L 24/48 |
| 2020/0279829 | A1* | 9/2020 | Elsherbini | H01L 25/065 |
| 2020/0303805 | A1* | 9/2020 | Ryoo | H01Q 21/28 |
| 2020/0313278 | A1* | 10/2020 | Liang | H01L 23/66 |
| 2021/0028797 | A1* | 1/2021 | Kim | H01Q 21/0025 |
| 2021/0343664 | A1* | 11/2021 | Chang | H01L 24/17 |
| 2021/0351518 | A1* | 11/2021 | Gorbachov | H01Q 9/0421 |

OTHER PUBLICATIONS

Manoj Stanley, Yi Huang, Ahmed Alieldin, Sumin David Joseph, Chaoyun Song, Tianyuan Jia; "A Dual-Band Dual-Polarised Stacked Patch Antenna for 28 GHz and 39 GHz 5G Millimetre-Wave Communication"; Apr. 2019; (5 pages).

Guangwei Yang, Qingqing Chen, Jianying Li, Shigang Zhou, Zijian Xing; "Improving Wide-Angle Scanning Performance of Phased Array Antenna by Dielectric Sheet"; IEEE Access, May 27, 2019, (11 pages).

Ho-Hsin Yeh; "Developments of 60 GHZ Antenna and Wireless Interconnect Inside Multi-Chip Module for Parallel Processor System"; Department of Electrical and Computer Engineering, The University of Arizona; 2013; (132 pages).

Sang-Hyuk Wi, Yong-Bin Sun, In-Sang Song, Sung-Hoon Choa, Il-Suek Koh, Yong-Shik Lee, Jong-Gwan Yook; "Package-Level Integrated Antennas Based on LTCC Technology"; IEEE Transactions on Antennas and Propagation; Aug. 2006; (9 pages).

J. M. Fernandez Gonzalez, A. Tamayo Dominguez, M. Sierra Perez, B. Galocha Iraguen, R. Martinez Rodriguez-Osorio, M. Sierra Castaner; "New Antenna Topologies for 5G Communication Systems"; IEEE MTT-S Latin America Microwave Conference; Dec. 14, 2016; (3 pages).

L. L. Wai; K. M. Chua; A. C. W. Lu; "A Compact Package with Integrated Patch Antenna for Single-Chip 60-GHZ Radios"; Progress in Electromagnetics Research; 2011; (12 pages).

M. Sc. Ruoyu Wang; "Integrated Planar Antenna Designs and Technologies for Millimeter-Wave Applications"; Integrated Planar Antenna Designs and Tech, for mm-Wave Applications; Apr. 2012; (9 pages).

International Search and Written Opinion for PCT/US2021/031156; dated Aug. 8, 2021; (9 pages).

* cited by examiner

LOW-COST, IPD AND LAMINATE BASED ANTENNA ARRAY MODULE

CROSS-REFERENCE TO RELATED APPLICATIONS

This application relates to and claims the benefit of U.S. Provisional Application No. 63/021,789, filed May 8, 2020 and entitled "LOW-COST, IPD AND LAMINATE BASED ANTENNA ARRAY MODULE," the disclosure of which is wholly incorporated by reference in its entirety herein.

STATEMENT RE: FEDERALLY SPONSORED RESEARCH/DEVELOPMENT

Not Applicable

BACKGROUND

1. Technical Field

The present disclosure relates generally to radio frequency (RF) communication devices and, more particularly, to a low-cost antenna array module.

2. Related Art

Wireless communication systems find applications in numerous contexts involving information transfer over long and short distances alike, and a wide range of modalities tailored for each need have been developed. Chief among these systems with respect to popularity and deployment is the mobile or cellular phone. Generally, wireless communications utilize a radio frequency carrier signal that is modulated to represent data, and the modulation, transmission, receipt, and demodulation of the signal conform to a set of standards for coordination of the same. Many different mobile communication technologies or air interfaces exist, including GSM (Global System for Mobile Communications), EDGE (Enhanced Data rates for GSM Evolution), and UMTS (Universal Mobile Telecommunications System).

Various generations of these technologies exist and are deployed in phases, the latest being the 5G broadband cellular network system. 5G is characterized by significant improvements in data transfer speeds resulting from greater bandwidth that is possible because of higher operating frequencies compared to 4G and earlier standards. The air interfaces for 5G networks comprise two frequency bands, frequency range 1 (FR1), the operating frequency of which being below 6 GHz with a maximum channel bandwidth of 100 MHz, and frequency range 2 (FR2), the operating frequency of which being above 24 GHz with a channel bandwidth between 50 MHz and 400 MHz. The latter is commonly referred to as millimeter wave (mmWave) frequency range. Although the higher operating frequency bands, and mmWave/FR2 in particular, offer the highest data transfer speeds, the transmission distance of such signals may be limited. Furthermore, signals at this frequency range may be unable to penetrate solid obstacles. To overcome these limitations while accommodating more connected devices, various improvements in cell site and mobile device architectures have been developed.

One such improvement is the use of multiple antennas at both the transmission and reception ends, also referred to as MIMO (multiple input, multiple output), which is understood to increase capacity density and throughput. A series of antennas may be arranged in a single or multi-dimensional array, and further, may be employed for beamforming where radio frequency signals are shaped to point in a specified direction of the receiving device. A transmitter circuit feeds the signal to each of the antennas with the phase of the signal as radiated from each of the antennas being varied over the span of the array. The collective signal to the individual antennas may have a narrower beam width, and the direction of the transmitted beam may be adjusted based upon the constructive and destructive interferences from each antenna resulting from the phase shifts. Beamforming may be used in both transmission and reception, and the spatial reception sensitivity may likewise be adjusted.

Unfortunately, the additional laminate layers required to manufacture an antenna array in a printed circuit board (PCB) are costly. Moreover, performance is limited by capacitive coupling between the antenna elements within the PCB. While forming the antenna array in a separate integrated passive device (IPD) may reduce costs by reducing the number of PCB layers, doing so may exacerbate the problem of capacitive coupling, since the dielectric constant of silicon between the array elements is significantly higher compared to laminate (e.g. 12 compared to 3 or 4).

BRIEF SUMMARY

The present disclosure contemplates various devices for overcoming the above drawbacks associated with the related art. One aspect of the embodiments of the present disclosure is an antenna array module. The antenna array module may comprise two or more antenna elements arranged in an array, each of the two or more antenna elements formed as a respective integrated passive device (IPD), and a multi-layer printed circuit board (PCB) including one or more metal layers forming one or more feed lines of the antenna elements. The antenna array module may comprise a radio frequency (RF) front end integrated circuit disposed on an opposite side of the multi-layer PCB from the two or more antenna elements, one or more signal output pins of the RF front end integrated circuit being connected to the one or more feed lines. The antenna array module may comprise conductive contacts external to the multi-layer PCB for routing input signals through the multi-layer PCB to one or more signal input pins of the RF front end integrated circuit.

Each of the IPDs may include a silicon substrate on which a metal layer defining a radiating component of the respective antenna element is formed. The silicon substrate may have a bulk resistivity greater than 1 kiloohm*centimeter.

Each of the IPDs may include a glass substrate on which a metal layer defining a radiating component of the respective antenna element is formed. In such embodiments, a real glass substrate-based IPD is contemplated.

Each of the IPDs may include a silicon substrate on top of the glass layer, the silicon substrate functioning as a lens through which the radiating component radiates. The silicon substrate may have a bulk resistivity greater than 1 kiloohm*centimeter. In such embodiments, a silicon substrate based IPD is contemplated, and the glass layers therein may be comprised of SiO2 layers on top of conventional silicon process such as complementary metal oxide semiconductor (CMOS).

Each of the IPDs may include a silicon substrate underneath the glass layer, the silicon substrate defining one or more through-silicon via (TSV) feeds, the radiating component being fed by the one or more feed lines via the one or more TSV feeds. The silicon substrate may have a bulk resistivity greater than 1 kiloohm*centimeter.

The antenna array module may comprise a metal shield disposed between the IPDs to reduce coupling therebetween. The metal shield may be formed on a topmost layer of the multi-layer PCB.

The multi-layer PCB may include an RF ground plane of the two or more antenna elements.

The one or more feed lines may be formed in the multi-layer PCB as one or more stripline structures.

The one or more feed lines of the antenna elements may comprise a first feed line and a second feed line for respective antenna elements, the first and second feed lines being formed in different metal layers of the multi-layer PCB.

Capacitive coupling between the IPDs may be through air.

The two or more antenna elements may be configured for one or more millimeter wave operating bands.

The two or more antenna elements may comprise four antenna elements.

The two or more antenna elements may comprise patch antenna elements.

The two or more antenna elements may be connected to the multi-layer PCB by respective micro-bumps defining antenna feeds connected to the one or more feed lines.

Another aspect of the embodiments of the present disclosure is an antenna array module. The antenna array module may comprise two or more antenna elements arranged in an array, each of the two or more antenna elements formed as a respective integrated passive device (IPD), and a multi-layer printed circuit board (PCB) including one or more metal layers forming one or more feed lines of the antenna elements. The two or more antenna elements may be connected to the multi-layer PCB by respective micro-bumps defining antenna feeds connected to the one or more feed lines.

Another aspect of the embodiments of the present disclosure is an antenna array module. The antenna array module may comprise two or more antenna elements arranged in an array, each of the two or more antenna elements formed as a respective integrated passive device (IPD), and a multi-layer printed circuit board (PCB) including one or more metal layers forming one or more feed lines of the antenna elements. The antenna array module may comprise conductive contacts external to the multi-layer PCB for routing input signals through the multi-layer PCB to the one or more feed lines.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The present disclosure encompasses various embodiments of low-cost antenna array modules. The detailed description set forth below in connection with the appended drawings is intended as a description of several currently contemplated embodiments and is not intended to represent the only form in which the disclosed invention may be developed or utilized. The description sets forth the functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second and the like are used solely to distinguish one from another entity without necessarily requiring or implying any actual such relationship or order between such entities.

Figure 1:
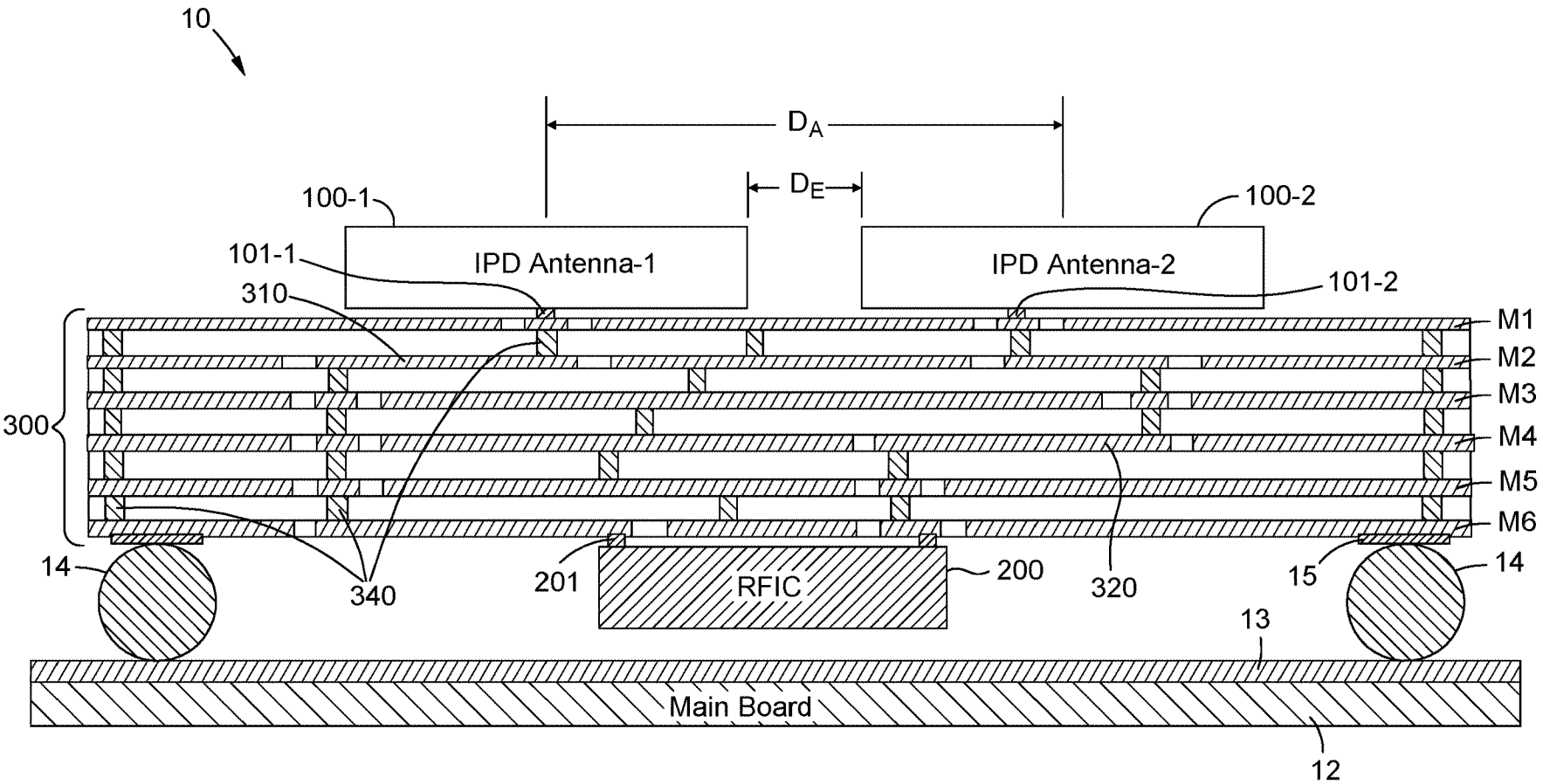
FIG. 1 is a cross-sectional view showing an antenna array module according to an embodiment of the present disclosure.

FIG. 1 is a cross-sectional view showing an antenna array module 10 according to an embodiment of the present disclosure. The antenna array module 10 may function as a phased array antenna for active beamformer applications. To this end, the antenna array module 10 may include two or more antenna elements 100-1, 100-2 (collectively referred to as antenna elements 100) arranged in an array, such as a two-by-two array or a four-by-one array. A distance $D_A$ between centers of the antenna elements 100 may be selected to produce a desired beamforming scanning angle, for example. Unlike conventional antenna arrays, each of the two or more antenna elements 100 of the antenna array module 10 may be formed as a respective integrated passive device (IPD). As such, a distance $D_E$ between antenna elements 100 may be defined outside of the IPDs, i.e., from an edge of one antenna element 100-1 formed as an IPD to an edge of an adjacent antenna element 100-2 formed as another IPD as shown in FIG. 1. This distance $D_E$, which may represent a portion of the separation distance $D_A$ between the centers of the antenna elements 100, may be through a medium having a significantly lower dielectric constant than that of the IPD, such as air (e.g. dielectric constant of 1 as opposed to dielectric constant of 12 in silicon layer of IPD). As a result, capacitive coupling between the antenna elements 100 can be significantly reduced, improving overall performance of the antenna array module 10. The capacitive coupling between the antenna elements 100 may be even less than it would be in the case of forming antenna elements within a printed circuit board (e.g. dielectric constant of 1 as opposed to dielectric constant of 3 or 4 in PCB), with the manufacturing cost also being reduced. In addition, due to the higher dielectric constant of silicon compared to laminate, each antenna element 100 may be smaller than they would be if formed in a PCB, reducing the overall size of the antenna array module 10.

The antenna array module 10 may be fabricated according to Antenna-in-Package (AiP) technology in which the plurality of antenna elements 100 are packaged together with or in close proximity to an RF front end integrated circuit (RFIC) 200 including RF front end circuitry for transmitting and receiving signals using the antenna elements 100. Routing to and from the RFIC 200, including feed lines and RF ground for the antenna elements 100, may be provided in a multi-layer printed circuit board (PCB) 300 packaged therewith. The entire antenna array module 10, which may also be referred to as an antenna chip, may then be connected to a main circuit board 12 (e.g. a main PCB of a smartphone or other mobile device), which may have a larger dimension than the antenna array module 10. For example, soldering pins or ball grid array (BGA) bumps or balls 14 may be provided on the antenna array module 10 (e.g. on the outside of the multi-layer PCB 300 or on a plastic or ceramic package containing the multi-layer PCB 300) for connection to a top metal layer 13 of the main circuit board 12.

The IPD defining each antenna element 100 may be a packaged or bare chip comprising a silicon or other semiconductor substrate and one or more metal layers defining radiating component(s) of the antenna element 100, including driven components and parasitic components, if any. The metal layer(s) defining the radiating component(s) may be formed on a silicon substrate, for example. To reduce parasitic effects, a high-resistivity silicon substrate may be used, for example, one having a bulk resistivity greater than 1 kiloohm*centimeter. In general, the radiating component(s) may be that of any antenna type, such as slot antennas, patch antennas, dipole antennas, etc., with any usable excitation type. The two or more antenna elements may be configured for one or more millimeter wave operating bands as may be used for 5G applications, for example. Each antenna element 100 may be connected to the multi-layer PCB 300 by one or more conductive contacts such as micro-bumps 101-1, 101-2 as shown in FIG. 1, which may define antenna feeds connected to one or more feed lines formed in the multi-layer PCB 300.

The multi-layer PCB 300 may be a laminate stack-up comprising a plurality of metal layers (e.g. metal layers M1-M6 in FIG. 1) separated by dielectric layers. The plurality of metal layers may include metal layers for routing to and from the RFIC 200 using interconnect vias 340, as well as one or more metal layers forming one or more feed lines of the antenna elements 100. In the illustrated embodiment, for example, first and second feed lines 310, 320 are provided for feeding the first and second antenna elements 100-1, 100-2, respectively, and are formed in respective metal layers M2 and M4 of the multi-layer PCB 300. The first feed line 310 is formed as a stripline structure grounded by ground planes defined by metal layers M1 and M3. The second feed line 320 is formed as a stripline structure grounded by ground planes defined by metal layers M3 and M5. Metal layer M1 may also serve as an RF ground plane for the antenna elements 100, with the radiating component(s) of the antenna elements 100 (e.g. radiating patches) being disposed at a predetermined distance $H_{GND}$ therefrom (see, e.g., predetermined distance $H_{GND}$ between RF ground plane M1 and radiating component(s) 110-2*a* and 110-2*b* of antenna elements 100-2*a* and 100-2*b* in FIGS. 2 and 3). Alternatively, RF ground planes may be formed within the IPD of each antenna element 100.

The RFIC 200 may be disposed on an opposite side of the multi-layer PCB 300 from the two or more antenna elements 100. In the example illustrated in FIG. 1, the RFIC 200 is disposed underneath and connected to the multi-layer PCB 300 (e.g. on the outside of the multi-layer PCB 300 or on a plastic or ceramic package containing the multi-layer PCB 300). To this end, an outer surface of the multi-layer PCB 300 or package may have conductive contacts such as micro-bumps 201 for connection of the RFIC 200 to the multi-layer PCB 300. The micro-bumps 201 may electrically connect input and output pins of the RFIC 200 to a lowermost metal layer M6 of the multi-layer PCB 300, with the RFIC 200 being disposed underneath the multi-layer PCB 300 as shown (i.e. between the multi-layer PCB 300 and the main circuit board 12 of the mobile phone or other device in which the antenna array module 10 is installed). The outer surface of the PCB 300 or package may also have conductive contacts such as soldering pads 15 and BGA balls 14 for routing input signals and other inputs from the main circuit board 12 through the multi-layer PCB 300 to one or more signal input pins, grounding pins, or DC and digital control pins of the RFIC 200 (via the micro-bumps 201). These inputs may be routed through the lowermost metal layer M6 of the multi-layer PCB 300, for example. The RFIC 200 may be mounted on the underside of the multi-layer PCB 300 and positioned such that it is between the multi-layer PCB 300 and the top metal layer 13 of the main circuit board 12. The antenna array module 10 may refer to the combination of the RFIC 200, the multi-layer PCB 300, and the antenna elements 100.

One or more signal output pins of the RFIC 200 may be connected to the one or more feed lines 310, 320, which may also be referred to as feed traces. RF signals from the RFIC 200 may go to the metal layer M2 feed trace 310 through feed via(s) 340 on metal layers M6, M5, M4, and M3. The feed trace(s) 310 in metal layer M2 may then excite one or more antenna feeds 101-1 (e.g. micro-bumps) of the first antenna element 100-1 through feed via(s) 340, which may connect the feed trace(s) 310 to the radiating component(s) of the first antenna element 100-1 through hole(s) in the RF ground plane M1. In the same way, RF signals from the RFIC 200 may go to the metal layer M4 feed trace 320 through feed via(s) 340 on metal layers M6 and M5. The feed trace(s) 320 in metal layer M4 may then excite one or more antenna feeds 101-2 (e.g. micro-bumps) of the second antenna element 100-2 through feed via(s) 340, which may connect the feed trace(s) 320 to the radiating component(s) of the second antenna element 100-2 through hole(s) in the RF ground plane M1.

Figure 2:
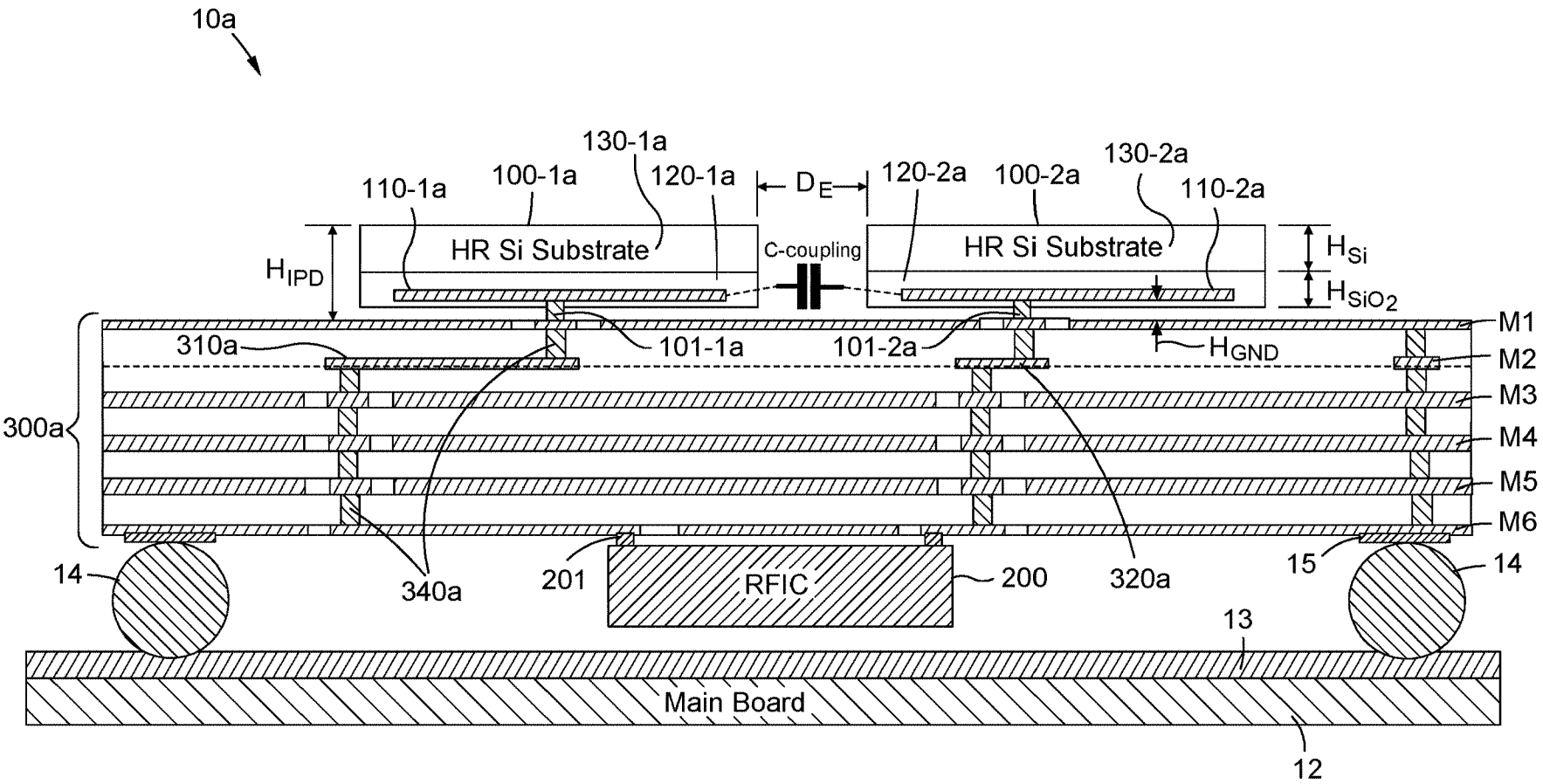
FIG. 2 is a cross-sectional view showing another antenna array module according to an embodiment of the present disclosure.

FIG. 2 is a cross-sectional view showing another antenna array module 10*a* according to an embodiment of the present disclosure. The antenna array module 10*a* may be the same as the antenna array module 10 of FIG. 1 and may include two or more antenna elements 100-1*a*, 100-2*a* (collectively referred to as antenna elements 100*a*) arranged in an array and formed as respective IPDs just like the antenna elements 100 of FIG. 1. As in the case of the antenna elements 100, a distance $D_E$ between the antenna elements 100*a* may be defined outside of the IPDs, i.e., from an edge of one antenna element 100-1*a* formed as an IPD to an edge of an adjacent antenna element 100-2*a* formed as another IPD as shown, such that capacitive coupling (represented by the capacitor symbol labeled "C-coupling") is reduced. In FIG. 2, an interior of each antenna element 100*a* (i.e. IPD 100*a*) is shown. As can be seen, each of the IPDs 100*a* of FIG. 2 includes a glass (e.g. $SiO_2$) layer 120-1*a*, 120-2*a* on which a metal layer defining a radiating component 110-1*a*, 110-2*a* of the respective antenna element 100*a* is formed. By forming the radiating component 110-1*a*, 110-2*a* on a glass layer 120-1*a*, 120-2*a*, antenna efficiency can be improved relative to the antenna elements 100 of FIG. 1, in which the radiating component(s) is formed on a silicon substrate associated with greater dielectric losses. In addition, the high cost and fragile nature of high-resistivity silicon may make glass preferable in the context of antenna arrays, where the entire IPD is fabricated with a glass-based IPD process. There may be such a preference even for 5G millimeter wave antenna array applications, where small arrays with four antenna elements can be several centimeters on a side, depending on the size of a single element and the required center-to-center distance $D_A$ for the particular application. However, such considerations may be inapplicable to the extent high-resistivity silicon with glass dielectric layers are utilized in accordance with other embodiments of the present disclosure as described below.

In the example of FIG. 2, each of the IPDs 100*a* includes a silicon substrate 130-1*a*, 130-2*a* on top of the glass layer 120-1*a*, 120-2*a*. A high-resistivity silicon substrate may be used, for example, one having a bulk resistivity greater than 1 kiloohm*centimeter. The glass layer 120-1*a*, 120-2*a* may have a height $H_{SiO2}$, for example, with the silicon substrate 130-1*a*, 130-2*a* having a height $H_{Si}$. The silicon substrate 130-1*a*, 130-2*a* may effectively function as a lens through which the radiating component 110-1*a*, 110-2*a* radiates, confining the radiated electromagnetic field in a narrower beam. By placing silicon on top of the radiating element in this way, the gain of each antenna element 100*a* may be increased, thus increasing the overall antenna array gain of the antenna array module 10*a*. It should be noted that the lens effect of the silicon substrate 103-1*a*, 130-2*a* may also occur in the silicon-based IPDs 100 of FIG. 1, with the thickness helping with gain enhancement due to the confined field.

Each antenna element 100*a* may be connected to the multi-layer PCB 300*a* by one or more conductive contacts such as micro-bumps 101-1*a*, 101-2*a* as shown in FIG. 2, such that the antenna element 100*a* protrudes from the top of the multi-layer PCB 300 by a total IPD height $H_{IPD}$. Like the multi-layer PCB 300 of FIG. 1, the multi-layer PCB 300*a* may comprise a plurality of metal layers M1-M6 separated by dielectric layers, including metal layers for routing to and from the RFIC 200 using interconnect vias 340*a*, as well as one or more metal layers forming one or more feed lines of the antenna elements 100*a*. In the illustrated example, the layout of the multi-layer PCB 300*a* is different from that of the multi-layer PCB 300. For example, both first and second feed lines 310*a*, 320*a* (for feeding first and second antenna elements 100-1*a*, 100-2*a*, respectively) are provided in the same metal layer M2. However, it is contemplated that either of the antenna array modules 10, 10*a* may use either of the illustrated multi-layer PCBs 300, 300*a*, or a different design.

Figure 3:
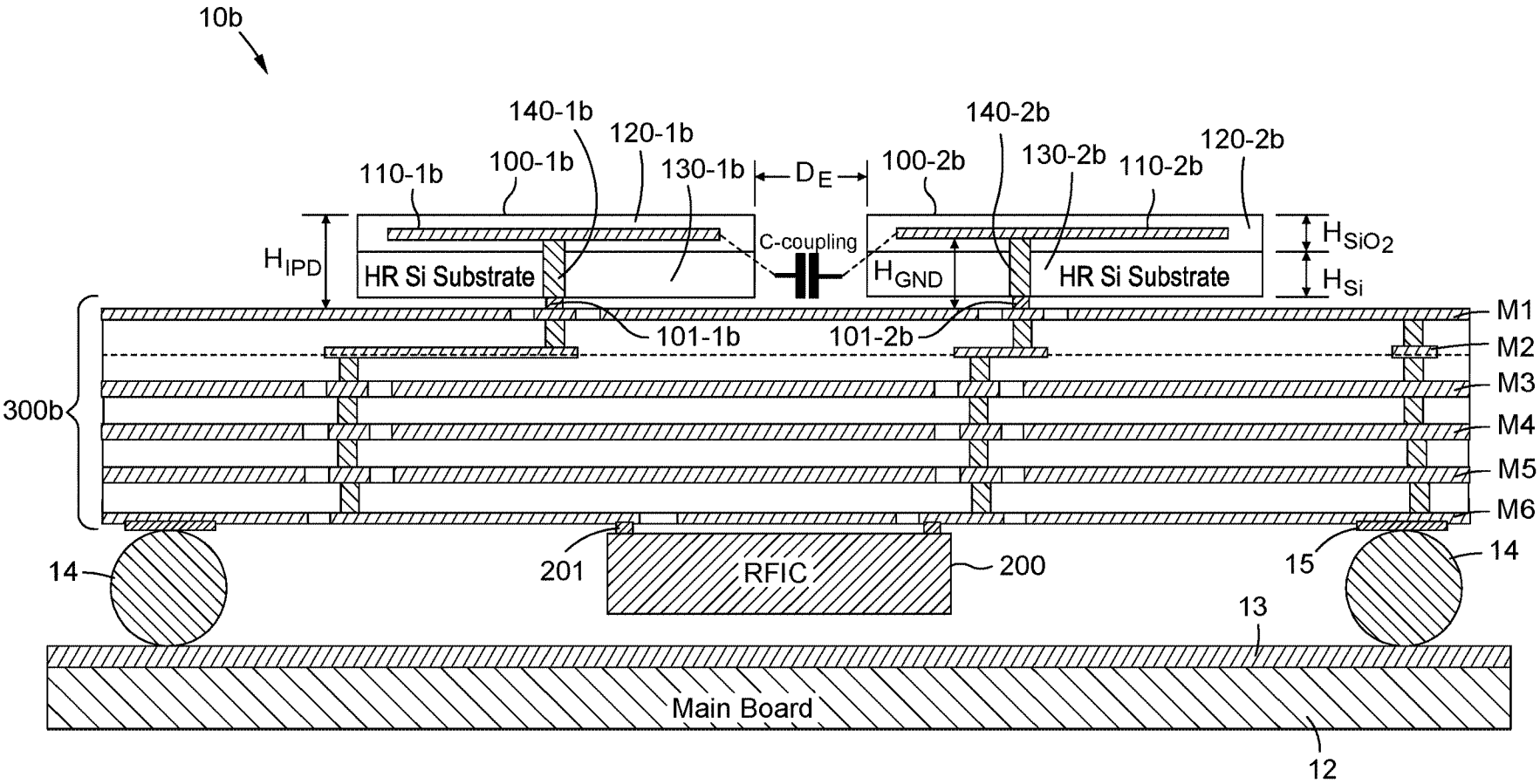
FIG. 3 is a cross-sectional view showing another antenna array module according to an embodiment of the present disclosure.

FIG. 3 is a cross-sectional view showing another antenna array module 10*b* according to an embodiment of the present disclosure. The antenna array module 10*b* may be the same as the antenna array module 10*a* of FIG. 2 and may include two or more antenna elements 100-1*b*, 100-2*b* (collectively referred to as antenna elements 100*b*) arranged in an array and formed as respective IPDs just like the antenna elements 100*a* of FIG. 2. Like the antenna elements 100*a* of FIG. 2, each of the antenna elements 100*b* (IPDs 100*b*) of FIG. 3 includes a glass (e.g. $SiO_2$) substrate 120-1*b*, 120-2*b* on which a metal layer defining a radiating component 110-1*b*, 110-2*b* of the respective antenna element 100*b* is formed, along with a silicon substrate 130-1*b*, 130-2*b* (e.g. a high-resistivity silicon substrate, such as one having a bulk resistivity greater than 1 kiloohm*centimeter). However, the antenna elements 100*b* of FIG. 3 differ from the antenna elements 100*a* of FIG. 2 in that the silicon substrates 130-1*b*, 130-2*b* are underneath the glass layers 120-1*b*, 120-2*b*. Due to the high dielectric constant of the silicon substrate 130-1*b*, 130-2*b*, each antenna element 100*b* may be sized smaller compared with the antenna elements 100*a* of FIG. 2, reducing the overall size of the antenna array module 10*b*. Each antenna element 100*b* may be connected to the multi-layer PCB 300*b* by one or more conductive contacts such as micro-bumps 101-1*b*, 101-2*b* as shown in FIG. 3. The radiating component 110-1*b*, 110-2*b* may be fed by one or more feed lines formed in the multi-layer PCB 300*b* via one or more through-silicon via (TSV) feeds defined through the silicon substrate 130-1*b*, 130-2*b*. The multi-layer PCB 300*b* may be the same as the multi-layer PCB 300*a* or the multi-layer PCB 300, for example.

Figure 4:
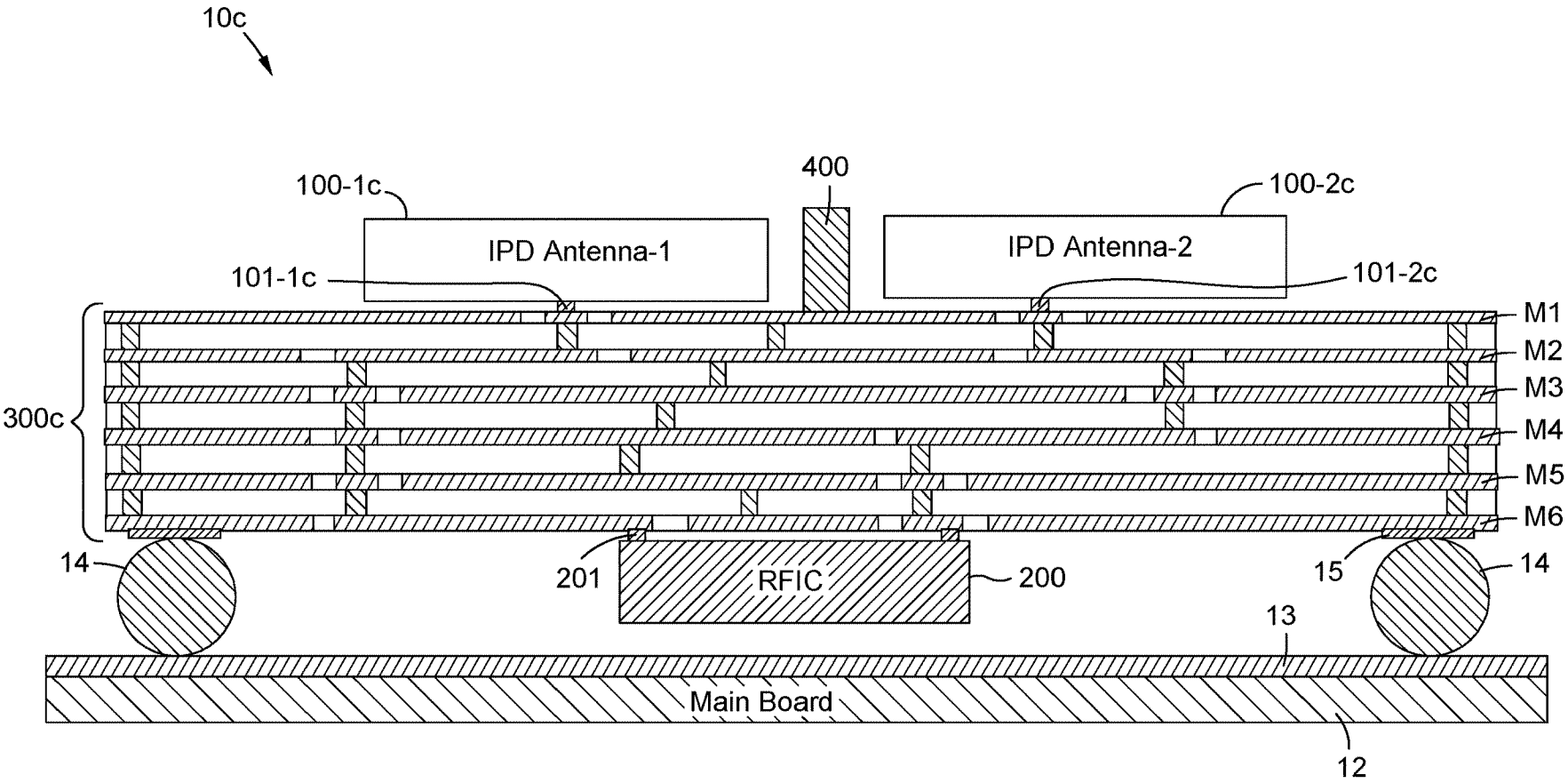
FIG. 4 is a cross-sectional view showing another antenna array module according to an embodiment of the present disclosure.

FIG. 4 is a cross-sectional view showing another antenna array module 10*c* according to an embodiment of the present disclosure. The antenna array module 10*c* may be the same as the antenna array module 10 of FIG. 1 and may include two or more antenna elements 100-1*c*, 100-2*c* (collectively referred to as antenna elements 100*c*) arranged in an array and formed as respective IPDs just like the antenna elements 100 of FIG. 1. Each antenna element 100*c* may be connected to the multi-layer PCB 300*c* by one or more conductive contacts such as micro-bumps 101-1*c*, 101-2*c* as shown in FIG. 4. The multi-layer PCB 300*c* may be the same as the multi-layer PCB 300 or the multi-layer PCB 300*a*, for example. The antenna array module 10*c* differs from the antenna array module 10 of FIG. 1 in that it includes a metal shield 400 disposed between the IPDs 100*c* to reduce coupling therebetween. The metal shield 400 can be formed in a variety of shapes and may be a metal bar or plate, for example, having a height that extends at least as high as the radiating components of the antenna elements 100*c* being separated. In the case of an array of more than two antenna elements 100*c* (such as a two-by-two array or a four-by-one array), a plurality of metal shields 400 can be used to separate each adjacent pair of antenna elements 100*c*. Alternatively, the metal shield 400 may be formed in an appropriate shape (when viewed from above) so as to separate multiple pairs of antenna elements 100*c*, such as a plus shape ("+") to separate the four antenna elements 100*c* of a two-by-two array. The metal shield 400 may be formed on a topmost layer of the multi-layer PCB 300*c*, which may be the same metal layer M1 that may serve as the RF ground plane of the antenna elements 100*c*, for example. By forming the antenna elements 100*c* as respective IPDs as described herein, separated by a medium such as air having a low dielectric constant, and then further separating the IPDs 100*c* with the metal shield 400, unwanted capacitive coupling can be further reduced, improving the overall performance of the antenna array module 10*c*.

While the addition of the metal shield 400 is shown in relation to an antenna array module 10*c* that is otherwise the same as the antenna array module 10 of FIG. 1, the disclosed subject matter is not intended to be limited in this respect. For example, the metal shield 400 may be added in between the antenna elements 100*a* of the antenna array module 10*a* (FIG. 2) or in between the antenna elements 100*b* of the antenna array module 10*b* (FIG. 3). In each case, capacitive coupling may be further reduced, resulting in improved performance.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An antenna array module comprising:

two or more antenna elements arranged in an array, each of the two or more antenna elements formed as a respective integrated passive device (IPD) each including a glass substrate on which a metal layer defining a radiating component of the respective antenna element is formed and a silicon substrate defining one or more through-silicon via (TSV) feeds, the radiating component being fed by the one or more feed lines via the one or more TSV feeds;

a multi-layer printed circuit board (PCB) including one or more metal layers forming one or more feed lines of the antenna elements;

a radio frequency (RF) front end integrated circuit disposed on an opposite side of the multi-layer PCB from the two or more antenna elements, one or more signal output pins of the RF front end integrated circuit being connected to the one or more feed lines; and conductive contacts external to the multi-layer PCB for routing input signals through the multi-layer PCB to one or more signal input pins of the RF front end integrated circuit.

2. The antenna array module of claim 1, wherein the silicon substrate has a bulk resistivity greater than 1 kiloohm centimeter.

3. The antenna array module of claim 1, wherein the silicon substrate functions as a lens through which the radiating component radiates.

4. The antenna array module of claim 3, wherein the silicon substrate has a bulk resistivity greater than 1 kiloohm centimeter.

5. The antenna array module of claim 1, wherein the silicon substrate has a bulk resistivity greater than 1 kiloohm centimeter.

6. The antenna array module of claim 1, further comprising a metal shield disposed between the IPDs to reduce coupling therebetween.

7. The antenna array module of claim 6, wherein the metal shield is formed on a topmost layer of the multi-layer PCB.

8. The antenna array module of claim 1, wherein the multi-layer PCB includes an RF ground plane of the two or more antenna elements.

9. The antenna array module of claim 1, wherein the one or more feed lines are formed in the multi-layer PCB as one or more stripline structures.

10. The antenna array module of claim 1, wherein the one or more feed lines of the antenna elements comprise a first feed line and a second feed line for respective antenna elements, the first and second feed lines being formed in different metal layers of the multi-layer PCB.

11. The antenna array module of claim 1, wherein capacitive coupling between the IPDs is through air.

12. The antenna array module of claim 1, wherein the two or more antenna elements are configured for one or more millimeter wave operating bands.

13. The antenna array module of claim 1, wherein the two or more antenna elements comprise four antenna elements.

14. The antenna array module of claim 1, wherein the two or more antenna elements comprise patch antenna elements.

15. The antenna array module of claim 1, wherein the two or more antenna elements are connected to the multi-layer PCB by respective micro-bumps defining antenna feeds connected to the one or more feed lines.

16. An antenna array module comprising:

two or more antenna elements arranged in an array, each of the two or more antenna elements formed as a respective integrated passive device (IPD), a multi-layer printed circuit board (PCB) including one or more metal layers forming one or more feed lines of the antenna elements;

a radio frequency (RF) front end integrated circuit disposed on an opposite side of the multi-layer PCB from the two or more antenna elements, one or more signal output pins of the RF front end integrated circuit being connected to the one or more feed lines;

conductive contacts external to the multi-layer PCB for routing input signals through the multi-layer PCB to one or more signal input pins of the RF front end integrated circuit; and a metal shield disposed between the IPDs to reduce coupling therebetween.

17. The antenna array module of claim 16, wherein the metal shield is formed on a topmost layer of the multi-layer PCB.

18. The antenna array module of claim 16, wherein each of the IPDs includes a silicon substrate on which a metal layer defining a radiating component of the respective antenna element is formed.

19. The antenna array module of claim 16, wherein each of the IPDs includes a glass substrate on which a metal layer defining a radiating component of the respective antenna element is formed.

20. The antenna array module of claim 19, wherein each of the IPDs includes a silicon substrate underneath the glass substrate, the silicon substrate defining one or more through-silicon via (TSV) feeds, the radiating component being fed by the one or more feed lines via the one or more TSV feeds.

* * * * *